US005280744A

United States Patent [19]

DeCarlo et al.

[11] Patent Number: 5,280,744

[45] Date of Patent: Jan. 25, 1994

[54] METHOD FOR AIMING TOWED FIELD ARTILLERY PIECES

[75] Inventors: Frank S. DeCarlo, Paramus; Frank L. Rosen, Parsippany; Desmond F. Carey, Brick, all of N.J.

[73] Assignee: AlliedSignal Inc., Morris Township, Morris County, N.J.

[21] Appl. No.: 826,499

[22] Filed: Jan. 27, 1992

[51] Int. Cl.[5] ..... F41G 3/04

[52] U.S. Cl. ..... 89/41.19; 89/41.03; 89/41.09; 89/41.11; 235/407; 364/423

[58] Field of Search ..... 33/236; 89/41.03, 41.09, 89/41.11, 41.19; 235/400, 404, 407; 364/423, 922.5

[56] References Cited

U.S. PATENT DOCUMENTS 3,930,317 1/1976 Johnston ..... 33/236

*Primary Examiner*—Stephen C. Bentley

*Attorney, Agent, or Firm*—Howard G. Massung

[57] ABSTRACT

Each towed field artillery piece in a battery of field artillery pieces uses a heading reference system having a "slave" azimuth gyro, pitch and roll angle sensors and a readout display for correcting azimuth and elevation during a fire mission. A master system includes a "master" azimuth gyro which is mechanically lined up with the axis of the "slave" azimuth gyros in the heading reference systems. The master system transfers azimuth information to the slave system, whereupon the slave system acts as a repeater for the information given by the master to confirm congruency of the master and slave systems and provides the present location of the respective field artillery pieces.

11 Claims, 3 Drawing Sheets

METHOD FOR AIMING TOWED FIELD ARTILLERY PIECES

BACKGROUND OF THE INVENTION

Prior to the present invention, considerable time has been required in setting up, emplacing and aiming towed field artillery pieces such as, for example, howitzers. The present method for accomplishing this, which has changed little since the inception of field artillery, involves a survey to establish a common azimuth reference for each of the field artillery pieces in a battery, with subsequent optical alignment of each artillery piece to insure that said piece is aimed in the direction of a target. The required optical alignment features panoramic telescope (PANTEL) apparatus. Thus, in summary, the prior art method requires an advance party to accomplish the survey, establish an aiming circle and emplace the field pieces for subsequent firing. Even under optimum conditions, this method is time consuming and critical to the success of a field artillery battery, and exposes personnel involved in the method to enemy counterfire.

Accordingly, it is an object of this invention to provide a method which reduces the time required for setting up, emplacing and aiming towed field artillery pieces while reducing the personnel required for same, as well as reducing the exposure of the required personnel to enemy counterfire.

It is another object of this invention to provide a method for the purposes described which is effective in unfamiliar locations and under adverse weather conditions.

It is yet another object of this invention to provide a method which improves the location and aiming capability of a field artillery battery and enhances the success of the battery mission.

SUMMARY OF THE INVENTION

This invention contemplates a method for aiming a plurality of towed field artillery pieces in a battery of said pieces including determining azimuth and location data and transferring this data to a heading reference system mounted on each of the field artillery pieces. Each heading reference system includes a "slave" (azimuth) gyro, two tilt sensors (pitch and roll), and a display for enabling a gunner to correct azimuth and elevation readings during a firing mission. An azimuth reference for the slave gyro is obtained from a master inertial system which has been aligned prior to emplacing the field artillery pieces at firing sites. Location data is obtained from a global positioning system.

The master inertial system includes a "master" (azimuth) gyro which is aligned with the axis of the "slave" (azimuth) gyro mounted on the field artillery piece. The master gyro transfers azimuth data to the slave gyro. The slave gyro acts as a repeater for the information from the master gyro to confirm the congruency of the master and slave gyros.

A mobile gyrocompass and position location system is transported via a host vehicle and functions as a gyrocompass/navigator, and is moved from one field artillery piece to another for repeating the azimuth data transfer as aforenoted until all of the field artillery pieces share a common firing azimuth. No optical devices are required for alignment, as has heretofore been the case.

Accordingly, this invention contemplates a method for aiming a plurality of towed field artillery pieces, comprising: mounting each of a plurality of heading reference systems on a corresponding one of the plurality of field artillery pieces; activating a mobile gyrocompass and location system for providing alignment and location data for each of the field artillery pieces; initializing each of the heading reference systems to an arbitrary heading; transporting the activated mobile gyrocompass and location system to each of the field artillery pieces, in turn; transferring the alignment and location data for each piece from the mobile gyrocompass and location system to the heading reference system mounted to said each piece, in turn, until all of the pieces are in azimuth alignment and are located, and displaying said azimuth alignment and location; transporting the activated mobile gyrocompass and location system to a fire direction center; and transmitting heading and location data from the fire direction center to each azimuth aligned and located piece, and displaying said transmitted data for enabling a gunner to correct the aim of said each piece during a firing mission.

DETAILED DESCRIPTION OF THE INVENTION

Figure 1:
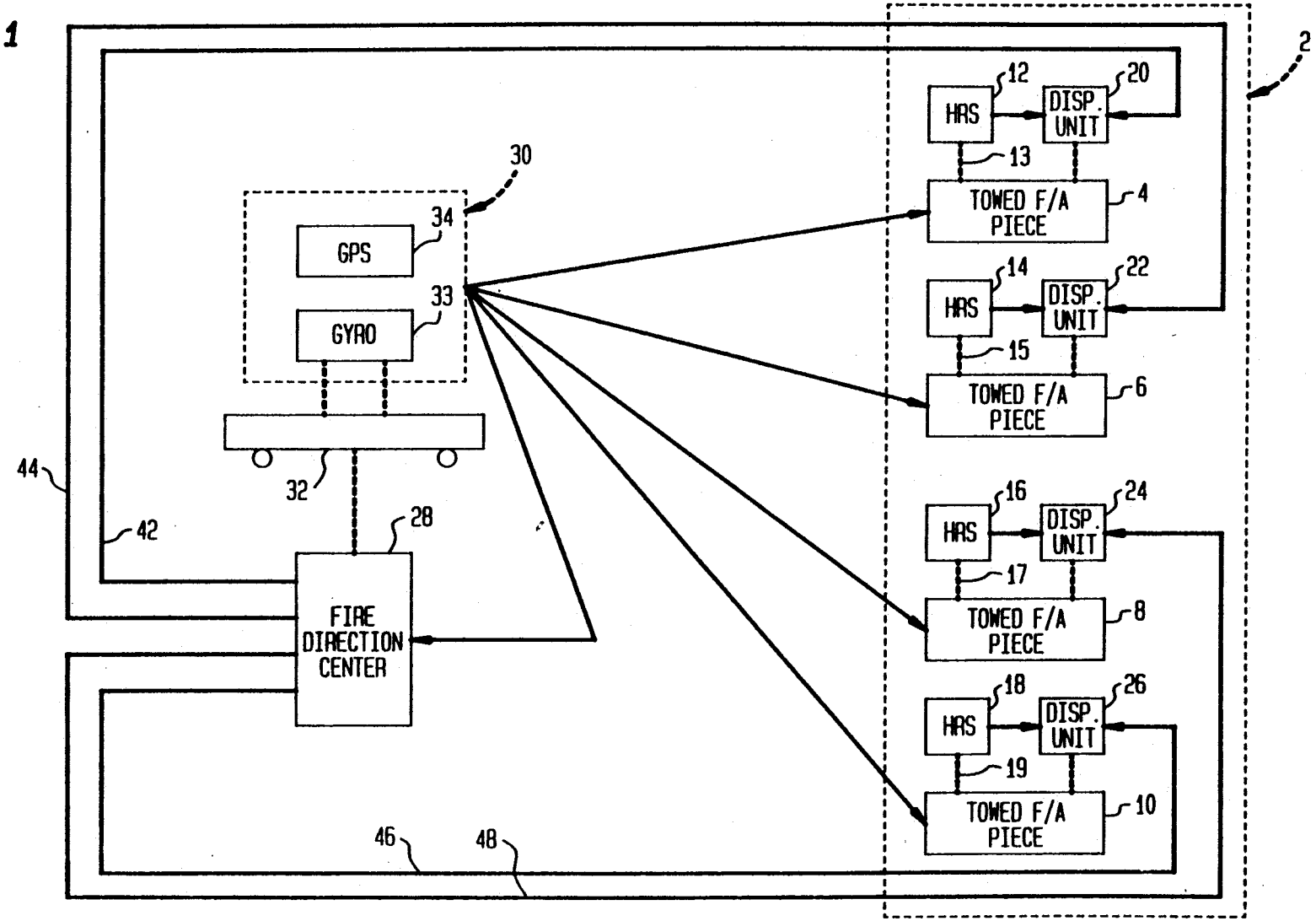
FIG. 1 is a block diagram generally illustrating a method according to the invention.

With reference to FIG. 1, a field artillary battery is designated by the numeral 2. Field artillery battery 2 includes a plurality of towed field artillery (F/A) pieces shown for purposes of illustration as four in number and designated by the numerals 4, 6, 8, and 10. Each F/A piece 4, 6, 8, and 10 has a heading reference system (HRS) such as 12, 14, 16 and 18, respectively, mounted on F/A azimuth pivots 13, 15, 17 and 19, respectively.

Display or indicator units 20, 22, 24 and 26 are connected to heading reference systems 12, 14, 16 and 18, respectively, and are connected to a fire direction center 28 for purposes to be hereinafter described.

A mobile gyrocompass and location system (MGLS) 30 is located on a prime mover, i.e. mobile vehicle, 32. MGLS 30 includes a "master" gyro 33 which provides a north reference and a global positioning system which provides the grid location of F/A's 4, 6, 8 and 10, as will be hereinafter described. Heading reference systems 12, 14, 16 and 18 are responsive to an initial heading from gyro 33, as well as to inputs from sensor (FIG. 3) indicating roll and pitch angles as will also be hereinafter described.

Thus, each towed F/A piece 4, 6, 8 and 10, has a heading reference system (HRS) 12, 14, 16 and 18, respectively, associated therewith and each battery 2 of towed F/A pieces has a mobile gyrocompass and location system (MGLS) 30 associated therewith.

Operationally, after emplacement of each towed F/A piece 4, 6, 8 and 10, the respective heading reference systems 12, 14, 16 and 18 are turned on and initialized to an arbitrary heading. Prior to emplacement of the towed F/A pieces, MGLS 30 is turned on.

When the towed F/A pieces are in place, MGLS 30 is ready to perform an alignment transfer and location function. This is accomplished by transporting MGLS 30 via vehicle 32 to each of the F/A pieces 4, 6, 8 and 10, in turn. Gyro 33 on MGLS 30 is placed on a mechanical alignment pad or base plate and a cable connects gyro 33 first, for example, to HRS 12 mounted to F/A piece 4. Thus, the alignment data from gyro 33 is automatically entered into HRS 12 and displayed on display device 20. At the same time, global positioning system (GPS) receiver 34, which is a conventional hand held device, stores the grid location of F/A piece 4.

Gyro 33 is then disconnected from HRS 12 and MGLS 30 is carried back to vehicle 32 and transported to the next towed F/A piece. The aforenoted procedure is repeated for each succeeding F/A piece 6, 8 and 10. When all F/A pieces 4, 6, 8 and 10 are in azimuth alignment and position located via MGLS 30, MGLS 30 is transported via vehicle 32 to fire direction center 28. Firing data from fire direction center 28 is transmitted via ground lines 42, 44, 46 and 48 to each display unit 20, 22, 24 and 26, respectively.

Figure 2:
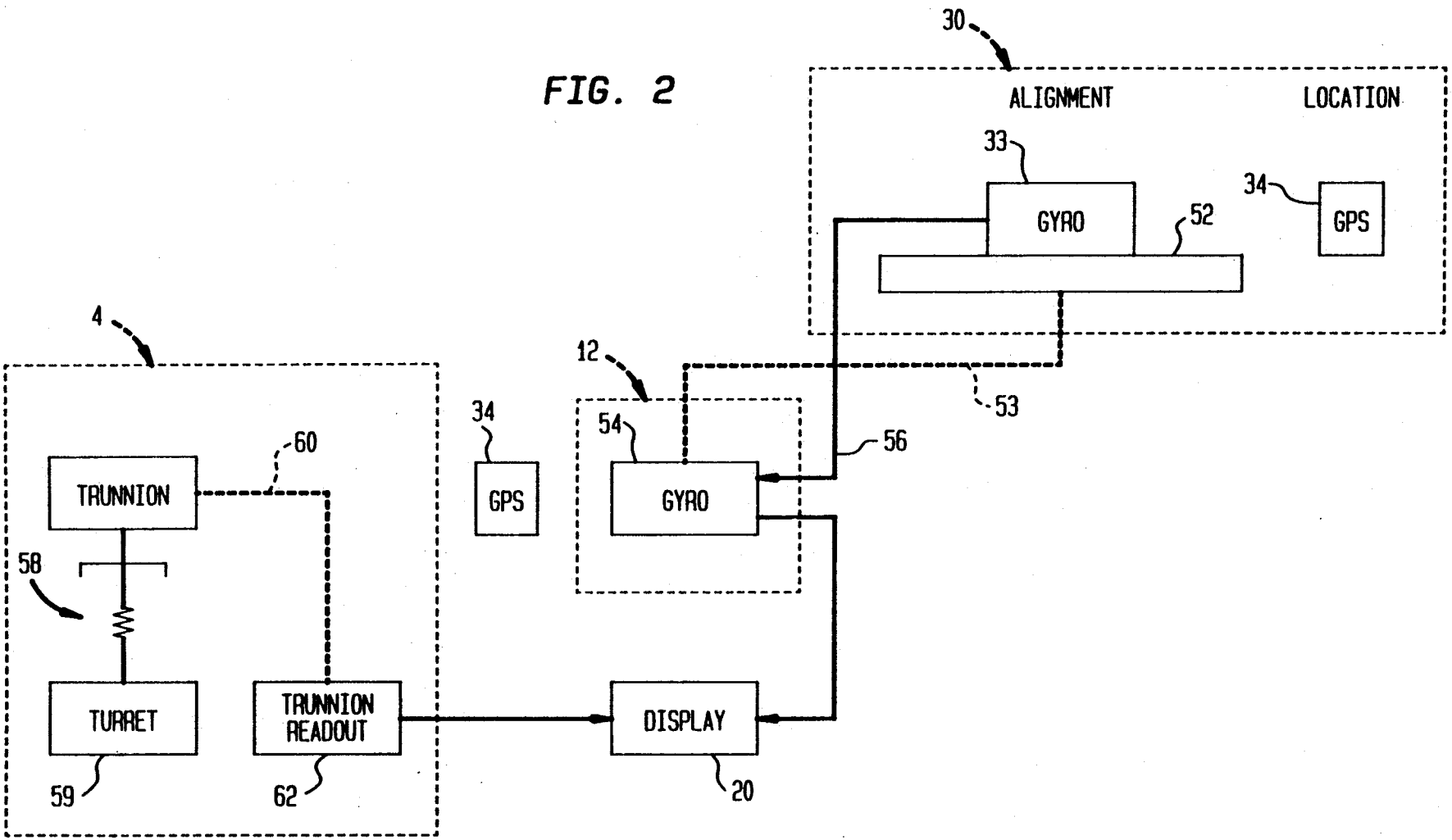
FIG. 2 is a block diagram particularly illustrating alignment transfer features of the invention.

With reference now to FIG. 2, the transfer of alignment and location data as heretofore referred to is performed as illustrated. Thus, "master" gyro 33 of MGLS 30 is disposed on a base plate 52 mounted by suitable mechanical means 53 to a "slave" gyro 54 in heading reference system 12. Gyros 33 (MGLS 30) and 54 (HRS 12) are connected via a cable 56. GPS 34 receives and stores the grid location of F/A piece 4. The alignment data from MGLS 30 is thus entered into HRS 12 and displayed on display device 20. GPS 34 transfers the stored grid location of F/A piece 4 to HRS 12.

F/A piece 4 has a trunion arrangement 58 mounted to a turret 59 thereof, and which trunion device 58 is connected by suitable mechanical means 60 to a trunion readout device 62. Trunion readout device 62 provides a signal which is applied to display 20, and which display 20 receives an output signal from gyro 33. Thus, the alignment and location data is automatically entered and displayed on display device 20.

It will now be recognized that MGLS 30 provides both azimuth alignment data and location data for F/A piece 4. The method has been described in relation to F/A piece 4 but is applicable to F/A pieces 6, 8 and 10 as will now be understood.

Figure 3:
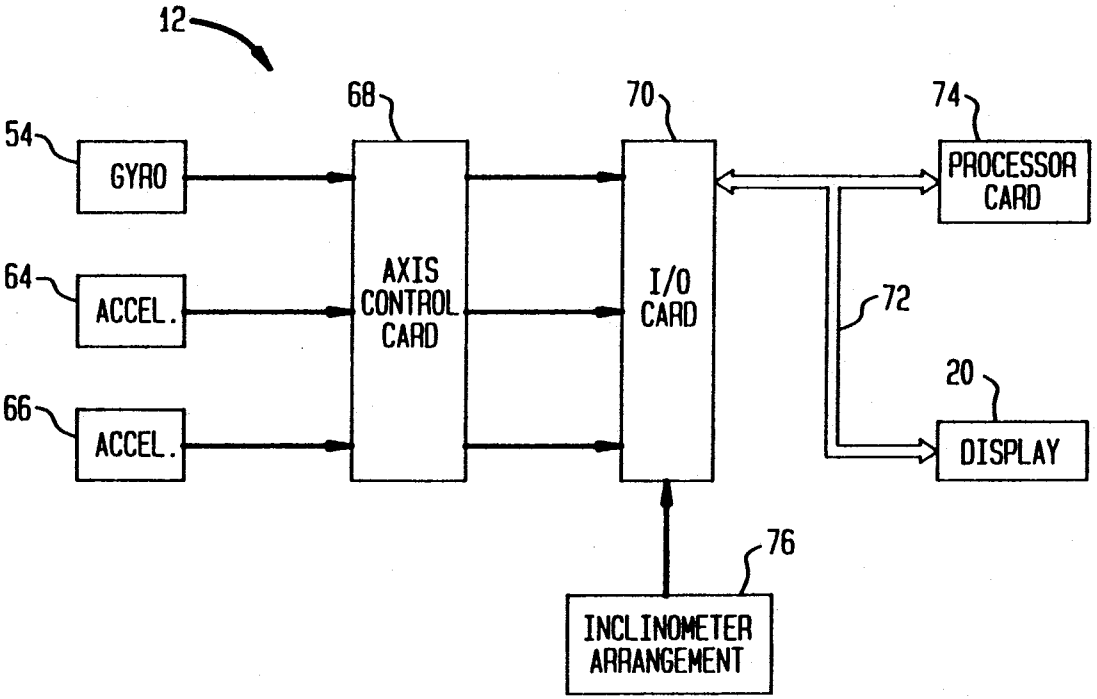
FIG. 3 is a block diagram particularly illustrating heading reference features of the invention.

A heading reference system (HRS) such as 12, 14, 16 and 18 is illustrated in FIG. 3, wherein HRS 12 is referred to for illustration purposes. Thus, HRS 12 includes "slave" gyro 54 and accelerometers 64 and 66. Accelerometers 64 and 66 are tilt sensors in pitch and roll, respectively. The outputs from gyro 54 and accelerometers 64 and 66 are applied to an axis control card 68 which provides outputs which are applied to an input/output (I/0) card 70. I/0 card 70 receives pitch signals from an inclinometer arrangement 76.

An input/output bus 72 is connected to I/O card 70 and is connected to a processor card 74 and to display 20. Display 20 enables a gunner to correct aiming readings during a firing mission.

It will now be recognized that MGLS 30 provides attitude and present location information for each F/A piece 4, 6, 8 and 10 and accomplishes alignment transfer. The attitude information includes azimuth heading relative to true north and roll and pitch angles relative to geodetic vertical. The present location information includes horizontal position (north/east) and altitude information. Alignment transfer is accomplished as aforenoted.

The basic functions of heading reference systems 12, 14, 16 and 18 are to maintain azimuth heading relative to true north, given the initial north reference via the alignment transfer, as aforenoted. The heading reference system also provides cant and elevation readouts and provides for a display of true azimuth/fire azimuth and elevation/fire elevation for towed F/A pieces 4, 6, 8 and 10.

Azimuth gyro 33 establishes azimuth heading from true north; establishes elevation angles from the horizontal plane; maintains heading information during the mobile period of vehicle 32; provides automatic azimuth gyro drift compensation when vehicle 32 is stationary; provides self-calibration of the system upon command; and gyrocompasses equally well at all attitudes within gyro gimble travel.

It will now be recognized that the method described reduces personnel required for setting up, emplacing and aiming towed field artillery pieces while reducing the exposure of the required personnel to enemy fire. The method is effective in unfamiliar locations and under adverse weather conditions and enhances the success of a field artillery battery mission.

With the above description of the invention in mind, reference is made to the claims appended hereto for a definition of the scope of the invention.

What is claimed is:

1. A method for aiming a plurality of towed field artillery pieces in a battery of said pieces, comprising:
   - mounting each of a plurality of heading reference systems on a corresponding one of the plurality of field artillery pieces;
   - activating a mobile gyrocompass and location system for providing alignment and location data for each of the field artillery pieces;
   - initializing each of the heading reference systems to an arbitrary heading;
   - transporting the activated mobile gyrocompass and location system to each of the field artillery pieces, in turn;
   - transferring the alignment and location data for each piece from the mobile gyrocompass and location system to the heading reference system mounted to said each piece, in turn, until all of the pieces are in azimuth alignment and are located, and displaying said azimuth alignment and location;
   - transporting the activated mobile gyrocompass and location system to a fire direction center; and
   - transmitting heading and location data from the fire direction center to each azimuth aligned and located piece, and displaying said transmitted data for enabling a gunner to correct the aim of said each piece during a firing mission.

2. A method as described by claim 1, wherein transferring the alignment and location data for each piece from the mobile gyrocompass and location system to the heading reference system mounted to each piece includes:
   - mounting an alignment plate to a "slave" gyro in the heading reference system mounted to each piece;
   - disposing a "master" gyro included in the mobile gyrocompass and location system on the alignment plate, for each piece, in turn;
   - connecting each "slave" gyro to the "master" gyro;
   - entering alignment data from the mobile gyrocompass and location system into each heading reference system, in turn;
   - the mobile gyrocompass and location system storing grid location data from the respective field artillery piece; and displaying the alignment and location data for each field artillery piece.

3. A method as described by claim 1, wherein transmitting heading and location data from the fire direction center to each azmuth aligned and located piece and displaying said transmitted data includes:

connecting the fire direction center to each piece through a ground cable from the fire direction center to said each piece.

4. A method as described by claim 2, including:

sensing data corresponding to the attitude of the turret of each field artillery piece; and displaying said sensed data with the alignment and location data for each field artillery piece.

5. A method as described by claim 4, wherein:

sensing data corresponding to the attitude of the turret of each field artillery piece includes sensing elevation, roll and pitch data.

6. A method as described by claim 1, wherein:

transporting the activated mobile gyrocompass and location system to each of the field artillery pieces, in turn and transporting the activated mobile gyrocompass and location system to a fire direction center includes:

disposing the mobile gyrocompass and location system on a vehicle and driving said vehicle to effect said transporting.

7. A method as described by claim 2, wherein activating a mobile gyrocompass and location system for providing alignment and location data for each of the field artillery pieces includes:

activating the "master" gyro for providing a north reference; and activating a global positioning system for providing the grid location of each of the field artillery pieces.

8. A method for aiming a plurality of towed field artillery pieces in a battery of said pieces, comprising:

mounting each of a plurality of heading reference systems on a corresponding one of the plurality of field artillery pieces;

activating a mobile gyrocompass and location system for providing alignment and location data for each of the field artillery pieces;

initializing each of the heading reference systems to an arbitrary heading;

transporting the activated mobile gyrocompass and location system to each of the field artillery pieces, in turn including disposing the mobile gyrocompass and location system on a vehicle and driving said vehicle to effect said transporting;

transferring the alignment and location data for each piece from the mobile gyrocompass and location system to the heading reference system mounted to said each piece, in turn, until all of the pieces are in azimuth alignment and are located, and displaying said azimuth alignment and location including mounting an alignment plate to a "slave" gyro in the heading reference system mounted to each piece, disposing a "master" gyro included in the mobile gyrocompass and location system on the alignment plate, for each piece, in turn, connecting each "slave" gyro to the "master" gyro, entering alignment data from the mobile gyrocompass and location system into each heading reference system, in turn, the mobile gyrocompass and location system storing grid location data from the respective field artillery piece and displaying the alignment and location data for each field artillery piece;

transporting the activated mobile gyrocompass and location system to a fire direction center including disposing the mobile gyrocompass and location system on the vehicle for effecting said transporting; and transmitting heading and location data from the fire direction center to each azimuth aligned and located piece, and displaying said transmitted data for enabling a gunner to correct the aim of said each piece during a firing mission including connecting the fire direction center to each piece through a ground cable from the fire direction center to said each piece.

9. A method as described by claim 8, including:

sensing data corresponding to the attitude of the turret of each field artillery piece; and displaying said sensed data with the alignment and location data for each field artillery piece.

10. A method as described by claim 9, wherein:

sensing data corresponding to the attitude of the turret of each field artillery piece includes sensing elevation, roll and pitch data.

11. A method as described by claim 8, herein activating a mobile gyrocompass and location system for providing alignment and location data for each of the field artillery pieces includes:

activating the "master" gyro for providing a north reference; and activating a global positioning system for providing the grid location of each of the field artillery pieces.

* * * * *